United States Patent [19]

Inui et al.

[11] 3,932,901

[45] Jan. 20, 1976

[54] FLUSH TOILET BOWL

[75] Inventors: Kanji Inui; Jun-Ichi Sakamoto, both of Hirakata; Yukihiro Gokoh, Neyagawa, all of Japan

[73] Assignee: Matsushita Electric Industrial Co., Ltd., Osaka, Japan

[22] Filed: Aug. 22, 1974

[21] Appl. No.: 499,512

[30] Foreign Application Priority Data

Aug. 28, 1973 Japan ..... 48-96365

[52] U.S. Cl. ..... 4/79; 4/76; 4/77; 4/92; 4/10; 4/108

[51] Int. Cl.[2] ..... E03D 11/10

[58] Field of Search ..... 4/76–81, 89, 4/90, 92, 52, 67 R, 10, 17, 18

[56] References Cited

UNITED STATES PATENTS

| | | | |
|---|---|---|---|
| 253,106 | 1/1882 | Sack | 4/79 X |
| 254,086 | 2/1882 | Alexander | 4/81 |
| 300,905 | 6/1884 | Semple | 4/81 |
| 1,107,515 | 8/1914 | Haas | 4/89 |
| 1,888,842 | 11/1932 | Allan | 4/77 |
| 2,119,328 | 5/1938 | Haberlin | 4/77 |
| 2,815,510 | 12/1957 | Mayne et al. | 4/79 |
| 3,038,169 | 6/1962 | O'Brien | 4/79 |
| 3,577,568 | 5/1971 | Johansen | 4/77 |
| 3,858,249 | 1/1975 | Howard | 4/78 X |
| 3,860,973 | 1/1975 | Uyeda et al. | 4/80 |

*Primary Examiner*—Richard E. Aegerter
*Assistant Examiner*—Charles E. Phillips
*Attorney, Agent, or Firm*—Wolfe, Hubbard, Leydig, Voit & Osann, Ltd.

[57] ABSTRACT

A flush toilet bowl of water reservoir containing and pedal operating type which is compact, easy to assemble and convenient and economical in operation is provided. The toilet bowl comprises a bowl unit including a bowl and a water reservoir formed between the bowl and an outer case and a supporting unit separable from the bowl unit and having a dropping port normally closed by a slidable valve and communicated with discharging port in the lower part of the bowl. The supporting unit comprises a diaphragm pump communicated with the water reservoir in the bowl unit for pumping its water to inner wall of the bowl, means for sliding the valve to open the dropping port, means for operating the diaphragm pump and treading pedals for operating the respective means separately. A further pedal is provided for simultaneously operating the treading pedals.

4 Claims, 17 Drawing Figures

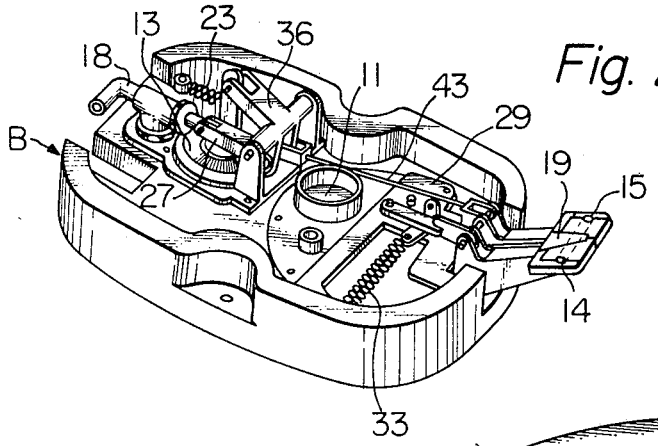
Fig. 2B
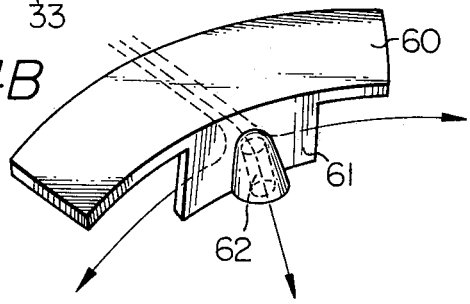
Fig. 4B
Fig. 5
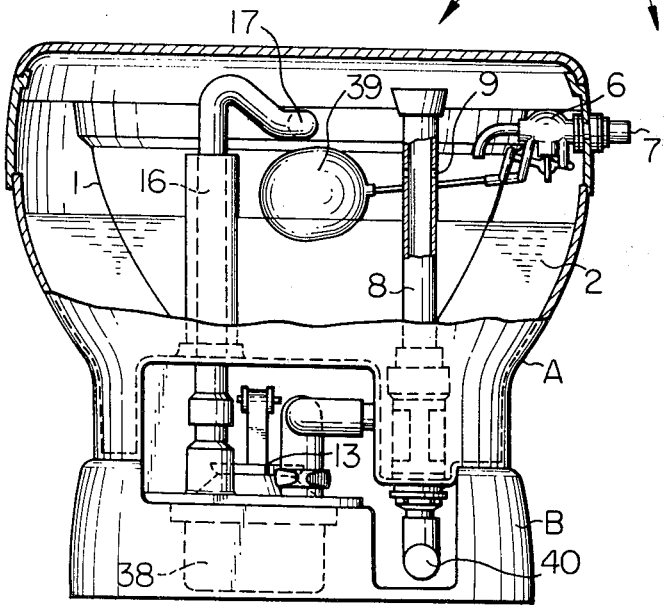

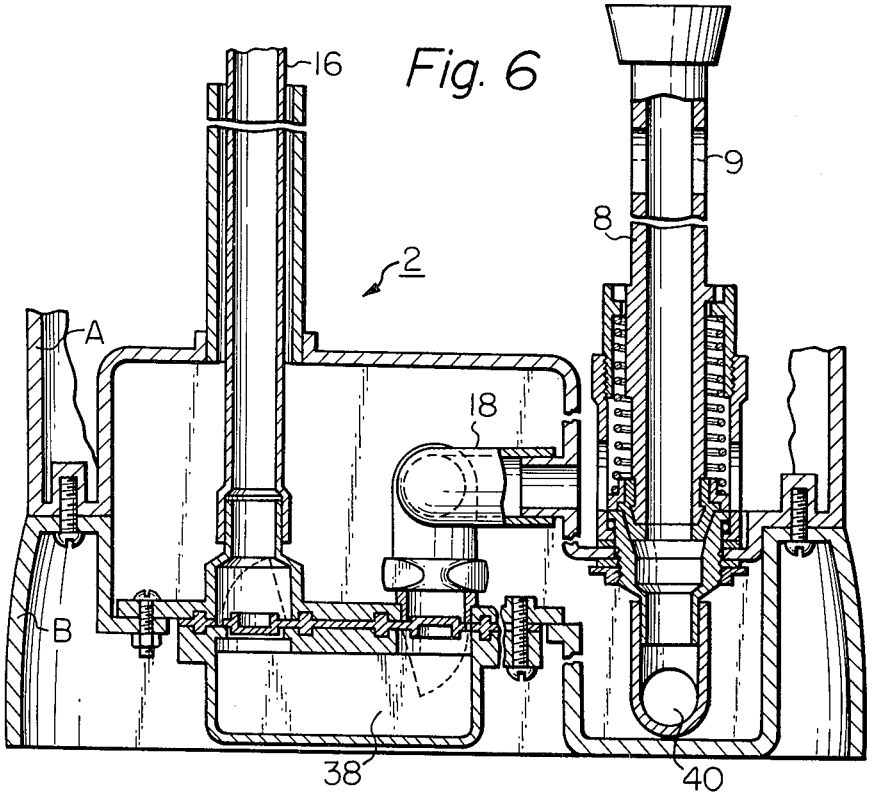
Fig. 6
Fig. 7
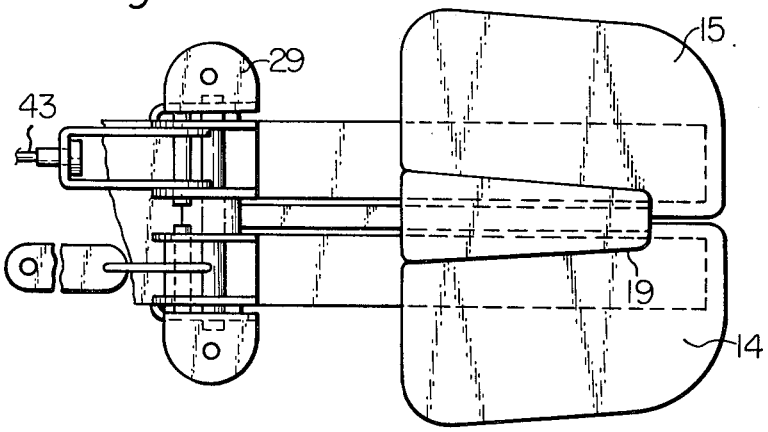

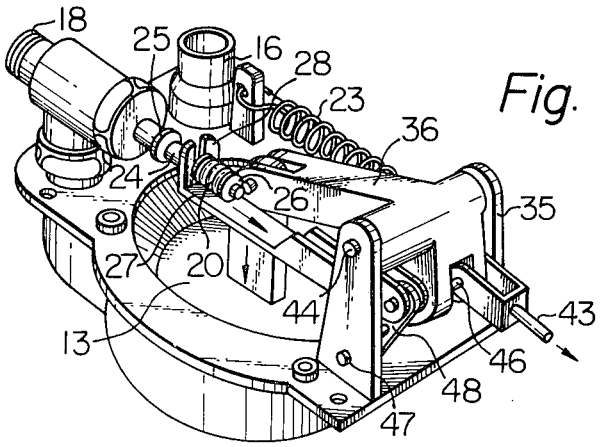
Fig. 10
Fig. 11
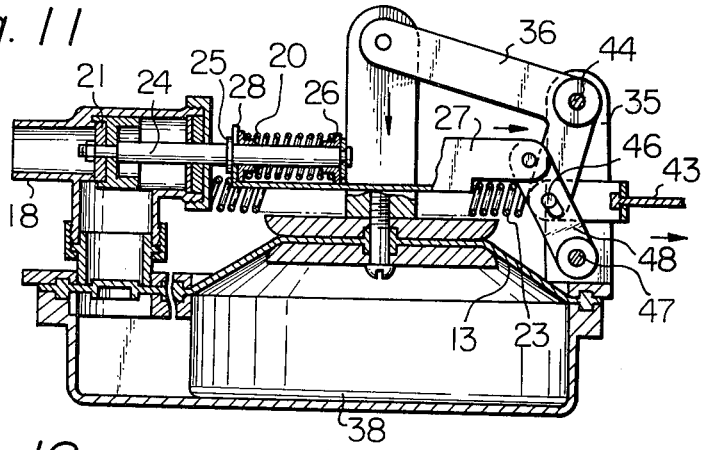
Fig. 12
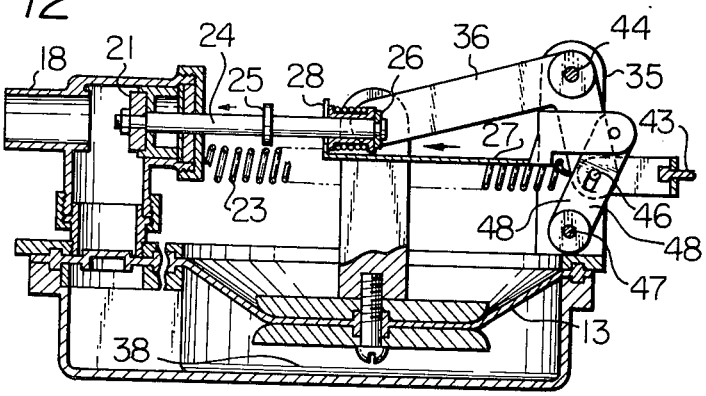

FLUSH TOILET BOWL

This invention relates to flush toilet bowls.

There are already suggested such flush toilet bowl apparatuses of this kind as, for example, of U.S. Pat. Nos. 3,340,545, 3,369,260, 3,411,162, 3,570,018 and 3,577,569. There are suggested as simple flush toilet bowls which are convenient for their installation. However, in the conventional apparatuses, the respective component elements are not unified and there are problems of the difficulty to assemble them in the production and the complicacy of their maintenance and inspection in the use. Further, the conventional apparatuses are not of a structure for saving water and requires to set a water tank of a large capacity.

The present invention has successfully solved the above described defects by forming a flush toilet bowl with two units respectively having a unique structure, one of which is a bowl unit having a bowl and water reservoir chamber and the other of which is a supporting unit having a pump for discharging water into said bowl, its operating mechanism and mechanism of operating a valve opening and closing a discharging port of the bowl.

An object of the present invention is, therefore, to provide a flush toilet bowl which is small in the size and is very easy to install.

Another object of the present invention is to provide a flush toilet bowl wherein the opening and closing of the discharging port and the discharge of water can be made respectively separately or simultaneously.

A further object of the present invention is to provide a flush toilet bowl having a simple mechanism which can discharge or feed water out of or into a diaphragm pump to discharge water in a desired order.

Another object of the present invention is to provide a flush toilet bowl which requires no water reservoir tank outside the bowl.

Yet another object of the present invention is to provide a flush toilet bowl which can be separated into a bowl unit and a supporting unit and is thus easy to manufacture.

The present invention shall be explained in the following with reference certain embodiments shown in accompanying drawings, in which:

FIGS. 2A and 2B are perspective views of a bowl unit and a supporting unit as separated from each other of the bowl of FIG. 1, respectively;

FIG. 4B is a perspective view showing a component shown in FIG. 4A.

FIG. 5 is a rear side elevation of the bowl shown in FIG. 1 with a part removed:

FIG. 6 is a fragmental sectioned view of water supply and overflow system in the bowl of the present invention, which is taken along line VI—VI in FIG. 3;

FIG. 7 is a fragmental plan view of pedals in the bowl of the present invention;

FIG. 10 is a fragmentary perspective view of operating mechanism for the diaphragm pump and a water stopping valve in the bowl of the present invention;

FIGS. 11–13 are explanatory sectioned views showing operational sequences of the mechanism shown in FIG. 10; and FIGS. 14 and 15 are fragmentary sectioned views showing in detail a discharging port and dropping port in the bowl of the present invention, respectively, wherein FIG. 14 is a section taken along line XIV—XIV and FIG. 15 is a section along line XV—XV in FIG. 8, respectively.

Figure 1:
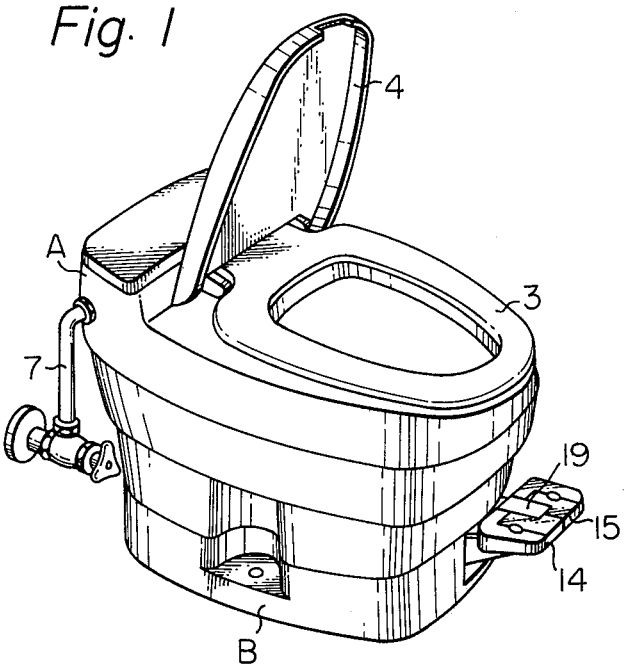
FIG. 1 is a perspective view showing an appearance of a flush toilet bowl of the present invention.

Referring first to FIG. 1 which showing an appearance of the flush toilet bowl of the present invention, a bowl body substantially comprises a bowl unit A and a supporting unit B, which are placed on each other to form the bowl body. The bowl unit A is provided with a lid 4 free to open and close and bowl seat 3 on the upper surface and is further with a water pipe 7 to feed water on one side part adjacent rear end. The supporting unit B and the bowl unit A as well are preferably made of plastics and the unit B is provided with first, second and third pedals 14, 15 and 19 respectively rotatably pivoted in the front lower part.

Figure 2A:
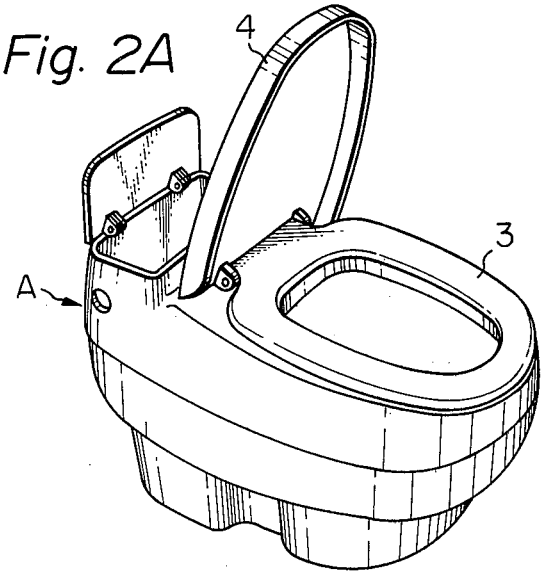

As seen in FIGS. 2A and 2B showing the respective bowl unit A and supporting unit B as separated from each other, both units can be easily separated from each other by removing bolts (not illustrated) screwed into the back surface of the supporting unit B to connect both units.

Figure 3:
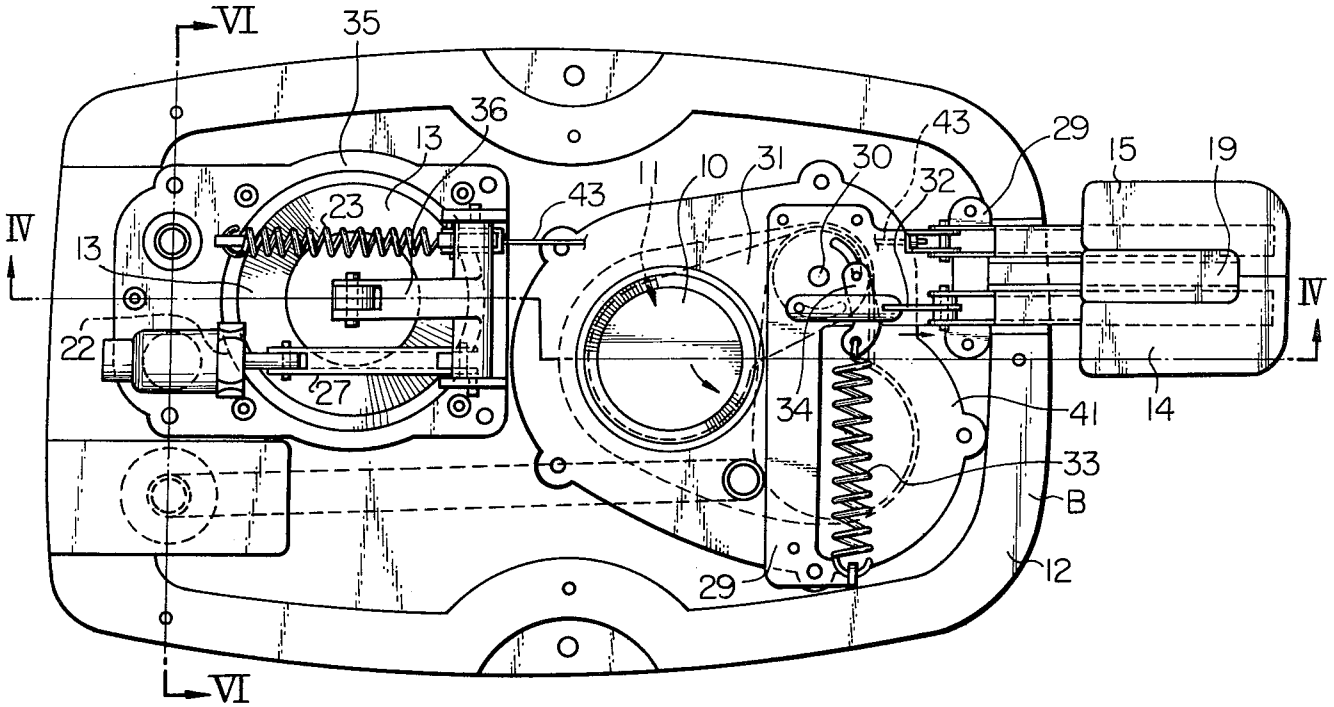
FIG. 3 is plan view of the supporting unit of FIG. 2B.

In FIG. 3 showing the upper surface plan view of the supporting unit B, the pedals 14, 15 and 19 are rotatably fitted to one end part of a supporting metal fixture 29 fixed to the unit B. 10 is a valve adapted to close and open a dropping port 11. This valve 10 comprises a circular part at the tip of an arm 31 rotatable in the direction indicated by the arrow about a shaft 30 fitted to a supporting stand 41 fixed to the supporting unit B. Said arm 31 is rotatably connected to one end of the first pedal 14 through an operating rod 32. 33 is a return spring fixed at one end to the other end part of the supporting metal fixture 29 fixed to a supporting plate 41 and hung at the other end on the arm 31 through a rod or arm plate 34.

35 is a supporting stand fixed to the supporting unit B and provided with a diaphragm pump 13, L-shaped lever 36 for operating said diaphragm pump 13, return spring 23 and operating lever 27 for operating a water stopping valve 21 (see FIGS. 11 and 12).

Figure 4A:
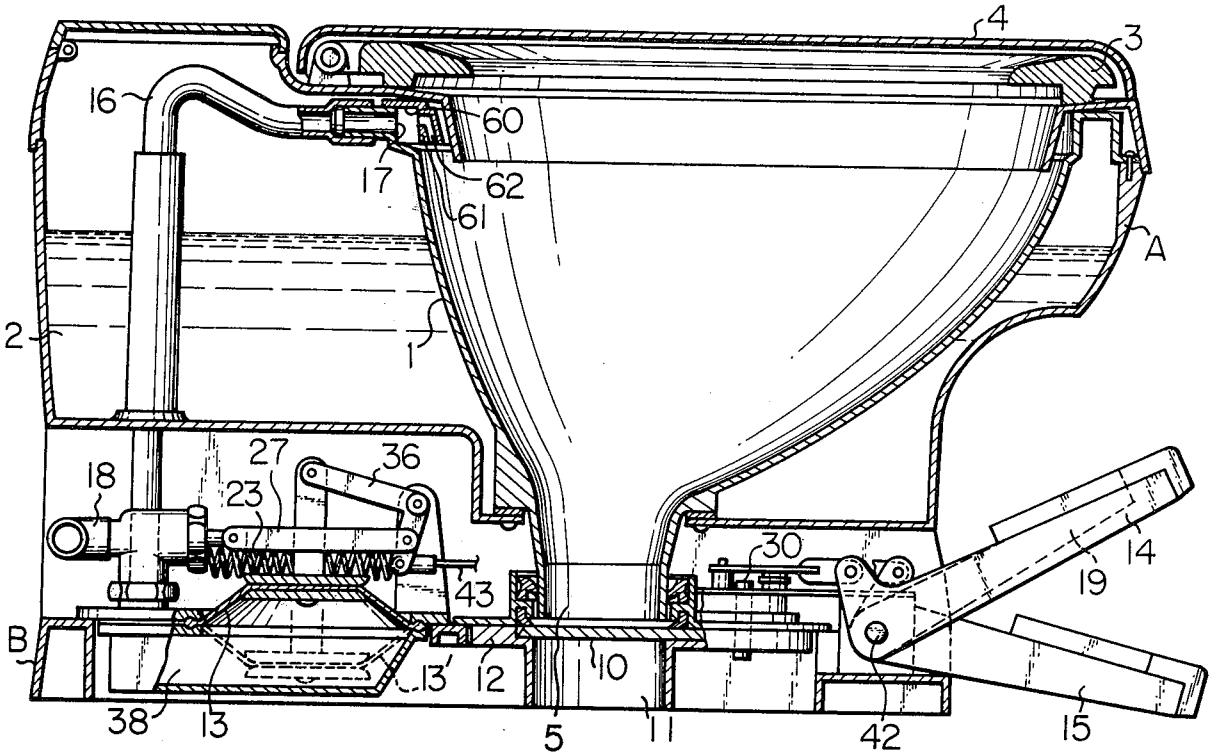
FIG. 4A is a sectioned view of the bowl of FIG. 1 taken along line IV—IV in FIG. 3.

In FIG. 4A showing a vertically sectioned view of the flush toilet bowl of the present invention on line IV—IV in FIG. 3, a bowl 1 is contained in the bowl unit A, as provided with the bowl seat 3 and lid 4 rotatably in the upper part, and is fixed in the lower part to the bottom of the bowl unit A. The bowl 1 has an excreta discharging port 5 in the lower part. This excreta discharging port 5 is opposed to the dropping port 11 provided in the supporting unit B. The valve 10 is rotatably provided between the discharging port 5 and dropping port 11 so as to be operated by treading the first pedal 14 as described later.

A water reservoir 2 is formed between the outer case and bowl 1 so as to accumulate water therein supplied through water pipe. A water jetting pipe 16 is provided upright within the water reservoir 2, which pipe is opened at upper tip disposed in the upper part of the bowl 1 so as to form a water delivering port 17. This water jetting pipe 16 is bent once downward adjacent the upper tip so as to position the delivering port 17 lower than the bent section, so that a certain amount of water existing between the bent section and the port 17 will fall into the bowl after flushing operation so as to form a layer or film of water on the discharging port 5 to act as a deodorizing means. At an upper part of the bowl 1 where opposing the water delivering port 17, there is secured such a member 60 as shown in FIG. 4B, which having a water stream shunting plate 61 and a central stream path 62 perforated at the center, so that the most of water delivered from the port 17 will collide with the shunting plate 61 to be shunted in leftward and rightward directions so as to flow along inner wall of the bowl 1, while a part of the water will pass through the central stream path 62 so as to fall down to central part of the discharging port 5. Thus, the water from the central stream path 62 will positively moisten toilet tissue in the bowl to sink the same so as to promote positive discharge of the tissue from the port 5. The lower part of the jetting pipe 16 is communicated with a diaphragm pump chamber 38. 13 is a diaphragm of the chamber 38, which is coupled to the operating lever 36.

As seen in FIG. 5, the water pipe 7 is provided with a water feeding plug 6 opened and closed by the fall and rise of a floating ball 39. When the floating ball 39 lowers, the water feeding plug will open and water will flow into the water reservoir 2. When a fixed water level is reached, the water feeding plug will be closed by the floating ball. 8 is a water discharging pipe having a water discharging hole 9 so that, when the water level rises to be higher than is required, water will be drained out of the bowl through the discharging hole 9 and an opening 40. 38 is the diaphragm pump chamber and is so adapted that, when the diaphragm 13 is pushed down, water will be pushed up into the water jetting pipe 16 so as to be jetted out in the upper part of the bowl through the water delivering port 17.

FIG. 6 shows detailes in a sectioned view of the water discharging pipe 8 having the water discharging hole 9, the water jetting pipe 16 and the diaphragm pump chamber 38.

In FIG. 7, there is shown the arrangement of the first to third pedals 14, 15 and 19, which are respectively pivoted to the supporting metal fixture 29 fixed to the supporting unit B. The first and second pedals 14 and 15 can be respectively separately rotated but, when the third pedal 19 is trod, the first and second pedals 14 and 15 will be able to be rotated simultaneously.

Figure 8:
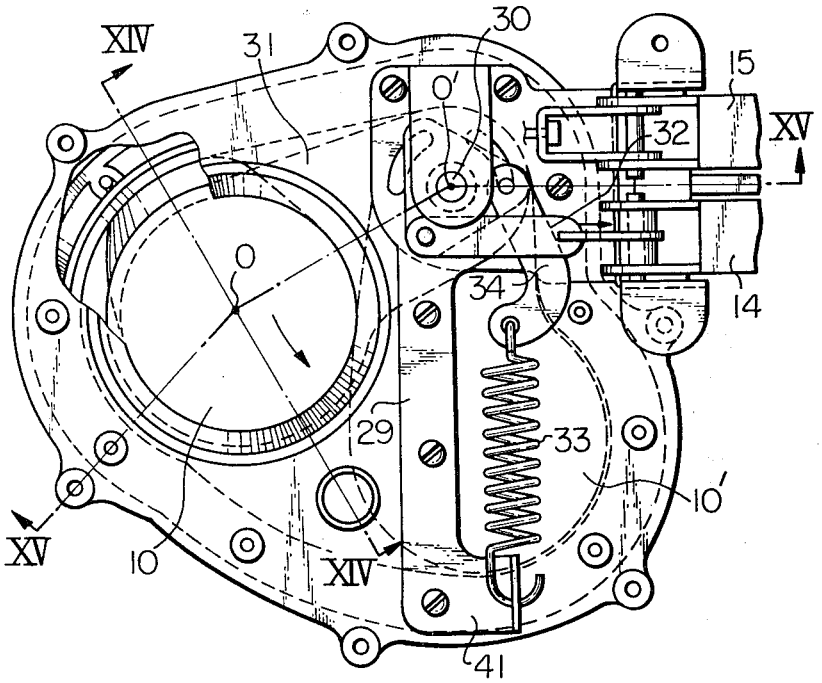
FIG. 8 is a fragmental magnified plan view of valve operating mechanism shown in FIG. 3.

FIG. 8 shows a mechanism of opening and closing the valve 10 by means of the first pedal 14. Details of the valve are as described in the explanation of FIG. 3 and its function shall be explained here. When the first pedal 14 is trod, an operating rod or lever 32 connected to a pivoted end of said pedal 14 and to the arm 31 having the valve 10 will be pulled in the direction indicated by the arrow in the drawing so that the arm 31 will rotate counter - clockwise (or in the direction indicatd by the arrow in the drawing) with the shaft 30 as a center and the valve 10 will be out of the port 5. When the first pedal treading force is removed, the original state will be returned by the force of the spring 33.

It should be appreciated in the above connection that the valve 10 normally closing the discharge port 5 is thus opened by the operation of the first pedal 14 without accompanying water flushing and that this respect is a unique feature of the bowl according to the present invention.

Figure 9:
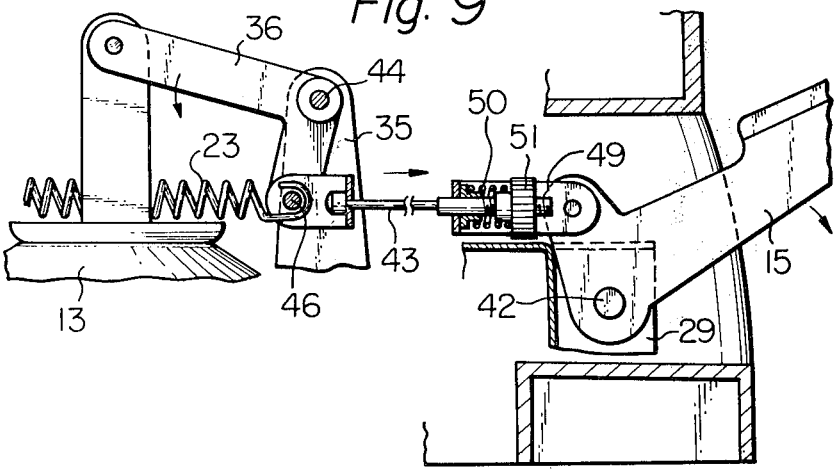
FIG. 9 is an explanatory view showing the operation of diaphragm pump in the bowl of the present invention.

FIG. 9 is to explain operational mechanism of the diaphragm pump 13 by means of the second pedal 15. In the drawing, when the second pedal 15 is trod in the direction indicated by the arrow, said pedal 15 will rotate with the shaft 42 of the supporting metal fixture 29 as a centre and will move an actuating rod or wire 43 in the direction indicated by the arrow, so as to rotate the L-shaped lever 36 in the direction indicated by the arrow with the shaft 44 of the supporting stand 35 as a centre and push down the diaphragm 13, so that the water in the pump chamber will be urged to flow out through the water jetting pipe 16.

As shown in FIG. 6, a water passing pipe 18 communicated with the bottom of the water reservoir chamber 2 is provided so as to connect the pump chamber 38 with the reservoir 2 through the water stopping valve 21.

Figure 13:
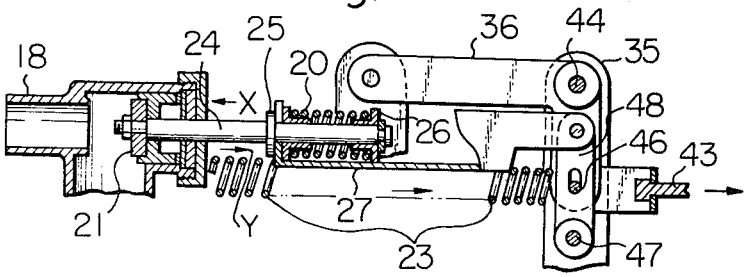

FIG. 10 is to show in a perspective view the operating mechanism of the diaphragm pump and in particular of the water stopping valve to be operated in cooperation with the former. In FIGS. 11–13, operational sequences of the mechanism are shown, wherein FIG. 11 shows the state where the pump 13 is in its uppermost position and the water stopping valve 21 is closing the pipe 18 and FIGS. 12 and 13 show the state where the pump 13 is its lowermost position and the valve 21 opens the pipe 18.

Referring to these drawings, the water stopping valve 21 is fitted to the tip of an operating rod 24 so that, as the operating rod 24 is urged in its longitudinal direction (indicated by the arrow X in FIG. 13) the water stopping valve 21 will contact and close the water passing pipe 18 and, when the operating rod 24 is pulled in reverse longitudinal direction (indicated by the arrow Y in FIG. 13), the water stopping valve 21 will open the pipe. This operating rod 24 is moved by a lever 27 which is operatively connected with the L-shaped lever 36 for operating the diaphragm 13. That is, when the second pedal 15 is trod, the operating rod or wire 43 will move in the direction indicated by the arrow in FIG. 11 and a pin 46 provided on the lever 36 will clockwise rotate an arm 48 rotatably fitted to the supporting stand 35 with a shaft 47 so that the lever 27 will move in the direction indicated by the arrow in FIG. 11 and bent tip part 28 of the lever 27 will move the end part 26 of theoperating rod 24 in the direction indicated by the arrow through a spring 20. In closing the water stopping valve 21, when the second pedal 15 is released, the lever 27 will return (in the direction indicated by the arrow X in FIG. 13) due to the returning force of the spring 23 and the tip part 28 of said lever 27 will push an annular projection 25 of the operating rod 24 also in the direction indicated by the arrow X to close the water stopping valve 21.

The relation between the operation of the diaphragm 13 and that of the water stopping valve 21 as performed by treading the second pedal 15 shall be described in the following.

The state shown in FIG. 11 wherein the water stopping valve 21 is closed shall be referred to as an initial state.

i. In the drawing, the water stopping valve 21 is closed. When the second pedal 15 is trod, the L-shaped lever 36 will rotate counter-clockwise, the upper part of the diaphragm 13 will be pressed on pushed down and water will be jetted out in the upper part of the bowl 1 through the water jetting pipe 16 as described before. In this case, the lever 27 will move in the direction indicated by the arrow and the tip 28 of the lever 27 will also move in the direction indicated by the arrow but the spring 20 will be only initiated to be compressed, the operating rod 24 will not move and the water stopping valve 21 will remain closed.

ii. The water stopping valve begins to open next. When the spring 20 is compressed sufficiently, the lever 27 will push the end part 26 of the operating rod 24 through the compressed spring 20 so that the water stopping valve 21 will be gradually opened. In this state, the water in the pump chamber 38 will be flowing out into the bowl. When the pedal 15 is further trod, the water stopping valve 21 will be opening but the pressure in the pump chamber 38 will be so high as to be in a jetting state and, therefore, water will not yet be fed into the pump chamber 38 through the water passing pipe 18. When the pedal 15 is trod to the extremity, the state in FIG. 12 will be achieved and the preparation for feeding water into the pump chamber will be completed.

iii. The force of treading the second pedal 15 is removed and the diaphragm 13 is returning to the initial state due to the force of the spring 23.

In this state, the lever 27 will move in the direction indicated by the arrow in FIG. 12 but the spring 20 will gradually extend at first, the water stopping valve 21 will remain open and water will quickly enter the pump chamber due to the hydraulic pressure difference in the reservoir tank and the suction accompanying the return of the diaphragm.

When the tip part 28 of the lever 27 contacts the annular projection 25 of the operating rod 24, the operating rod 24 will be pushed in the direction indicated by the arrow X so that the water stopping valve 21 will gradually close the water passing pipe. Thus, just before the returning of the diaphragm 13 is completed, the water stopping valve of the water passing pipe 18 will be closed.

In the present invention, as the two mechanical elements of the pump set and valve set are compiled in the supporting unit as described above, the assembling in the production and the maintenance and inspection in the use are easy.

Further in the present invention, as described above, the water stopping valve is provided with a delaying mechanism by means of the spring 20 and is operatively connected with the second pedal 15 operating the diaphragm pump 13 so that, due to the delaying mechanism, when the diaphragm is operated by the second pedal, the water stopping valve 21 will be opened at a fixed time after the diaphragm is pressed and will be closed before the returning of the diaphragm pump is completed. By the way, as the water stopping valve 21 will thus close, even if the diaphragm pump is damaged, the water reservoir part and diaphragm pump will be intercepted from each other and water will not leak out ceaselessly through the damaged part.

Further, as only the water accumulated within the diaphragm is jetted out at once, a large amount of water will not be used. Therefore, it is effective to save water.

In connecting the second pedal 15 with the operating rod or wire 43, as shown in FIG. 9, a connecting metal fixture 49 is pivoted to the second pedal 15, the wire 43 is passed through said connecting metal fixture 49 and a nut 51 is screwed to the wire 43 through a spring 50 so that the length between the tip of the wire 43 and the connecting metal fixture 49 can be adjusted by rotating this nut 51. Therefore, even though the operation of treading the second pedal 15 is the same, the amount of water jetted out of the diaphragm pump 13 through the water jetting pipe 16 will be different. Therefore, it is possible to adjust the amount of water to be used.

Figure 14:
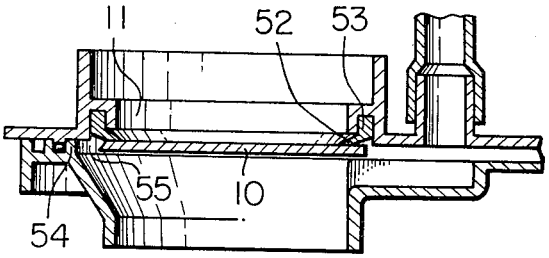
Figure 15:
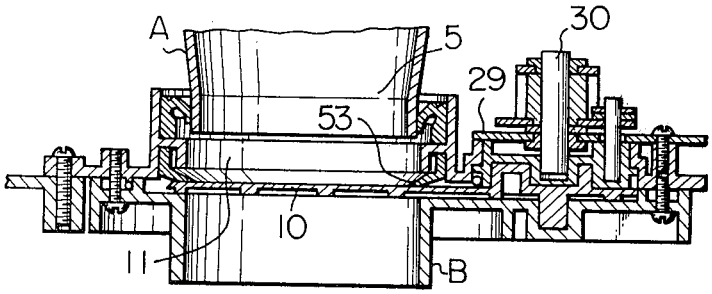

In FIGS. 14 and 15 showing detailed views of the discharging post and dropping port, respectively, the dropping port 11 is provided on the inner peripheral surface with a sealing member 53 laminate on the edge 52 and having an elasticity and the laminate edge 52 projects diagonally downward. The valve part 10 is rotated to move horizontally together with the arm and closes the dropping port 11 while pressing the edge 52 of the sealing member 53. In such case, as the sealing member 53 has an elasticity and is laminate on the edge 52 and the laminate edge 52 projects diagonally downward to be in the form of a funnel, the sealing member will be in contact intimate enough with the horizontally moving valve 10 without being so greatly deformed. In case the valve 10 rotates and horizontally moves to close the dropping port 11, tissue paper or the like will be likely to be inserted between the end part in the closing direction of the valve 10 and the wall part 54 of the dropping port 11. However, in the present invention, as shown in FIG. 14, a play gap or space 55 is formed between the end part in the closing direction of the valve 10 and the wall part 54 of the dropping port 11 and, therefore, paper or the like is not likely to be pushed and inserted by the valve 10. Even if paper or the like is inserted between the sealing member 53 and the valve 10, it will easily flow off when the valve 10 is opened. Thus, paper or the like is not likely to successively hang and accumulate without flowing off.

What is claimed is:

1. A flush toilet bowl comprising a bowl unit containing a bowl having a bowl seat and a lid in the upper part and a discharging port in the lower part and forming a water reservoir chamber between the bowl and an outer case, and a supporting unit formed intergrally with said bowl unit on the lower surface of the bowl unit, said supporting unit being provided with a dropping port opposed to the discharging port of the bowl, a valve slidable in the horizontal direction when a first pedal located on said supporting unit is trod for opening said dropping port, a diaphragm pump, a means for pressing the diaphragm pump when a second pedal located on said support unit is trod, a means for operating an opening and closing valve to feed water into the diaphragm pump actuated by said pressing means for the diaphragm pump, and a water jetting pipe connecting said diaphragm pump and a water delivering port in the upper part of the bowl with each other, said means for pressing forces water from said diaphragm through said water jetting pipe into said bowl, said means for pressing the diaphragm pump and said means for operating the opening and closing valve being connected with each other through a delaying means opening said water feeding valve at a fixed time after said diaphragm pump is pressed and closing said water feeding valve just before said diaphragm pump returns to an initial position.

2. A flush toilet bowl according to claim 1 wherein said delaying means comprises a lever operatively connected at an end with an L-shaped lever, said L-shaped lever presses the diaphragm by the operation of the second pedal and at the other end engaged between two projections provided on an operating rod connected with said water feeding valve.

3. A flush toilet bowl comprising a bowl unit containing a bowl having a bowl seat and a lid in the upper part and a discharging port in the lower part and forming a water reservoir chamber between the bowl and an outer case, and a supporting unit formed intergrally with said bowl unit in the lower surface of the bowl unit, said supporting unit being provided with a dropping port opposed to the discharging port of the bowl, a valve slidable in the horizontal direction when a first pedal located on said supporting unit is trod for opening said dropping port, a diaphragm pump, a means for pressing the diaphragm pump when a second pedal located on said supporting unit is trod, a means for operating an opening and closing valve to feed water into the diaphragm pump is actuated by said pressing means for the diaphragm pump, and a water jetting pipe connecting said diaphragm pump and a water delivering port in the upper part of the bowl with each other, said means for pressing forces water from said diaphragm through said water jetting pipe into said bowl, a water passing pipe communicating said resevoir with said pump, said means for pressing the diaphragm comprises said second pedal pivoted to a supporting metal fixture fixed to said supporting unit, a connecting metal fixture pivoted to said second pedal, an operating rod connected with said connecting metal fixture, an L-shaped lever connected at one end to said operating rod and at the other end to the diaphragm pump, said L-shaped lever being pivoted at its angled portion to a supporting stand fixed to the supporting unit; said operating means for opening and closing said water feeding valve comprises a lever pivoted at one end to said one end of the L-shaped lever so as to be driven upon rotation of the L-shaped lever, an operating rod having at one end a pair of spaced projections and connected at the portion between said projections to said lever; and said water feeding valve comprises a water stopping valve provided at the other end of said operating rod of the operating means for opening and closing said water passing pipe.

4. A flush toilet bowl according to claim 3 wherein said connection between the operating rod and the lever in the operating means for the water feeding valve is performed through a delay means comprising a spring.

* * * * *